US005921702A

United States Patent [19]

Fitch

[11] Patent Number: 5,921,702

[45] Date of Patent: Jul. 13, 1999

[54] DISPLACEABLE GUARD RAIL BARRIERS

[76] Inventor: John C. Fitch, 433 Salmon Kill Rd., Lime Rock, Lakeville, Conn. 06039

[21] Appl. No.: 08/691,918

[22] Filed: Aug. 1, 1996

Related U.S. Application Data

[51] Int. Cl.[6] ..... E01F 15/04

[52] U.S. Cl. ..... 404/6; 256/13.1

[58] Field of Search ..... 404/6, 7; 256/1, 256/13.1, DIG. 6

[56] References Cited

U.S. PATENT DOCUMENTS

| | | | |
|---|---|---|---|
| 369,571 | 9/1887 | Van Cleave . | |
| 487,573 | 12/1892 | Jobe . | |
| 2,093,577 | 9/1937 | Shepherd | 256/13.1 |
| 2,265,698 | 12/1941 | Opgenorth . | |
| 2,337,626 | 12/1943 | Sawyer . | |
| 2,465,936 | 3/1949 | Schultz . | |
| 3,307,833 | 3/1967 | Muller et al. . | |
| 3,332,666 | 7/1967 | Gray | 404/6 |
| 3,353,795 | 11/1967 | Muller . | |
| 3,369,634 | 2/1968 | Mazelsky . | |
| 3,436,057 | 4/1969 | Mazelsky . | |
| 3,467,361 | 9/1969 | Moschettini . | |
| 3,567,184 | 3/1971 | Yancey . | |
| 3,638,913 | 2/1972 | Persicke . | |
| 3,690,619 | 9/1972 | Kendall . | |
| 4,090,694 | 5/1978 | Vincent . | |
| 4,138,095 | 2/1979 | Humphrey . | |
| 4,678,166 | 7/1987 | Bronstad . | |
| 5,022,782 | 6/1991 | Gertz et al. | 404/6 |
| 5,269,623 | 12/1993 | Hanson . | |
| 5,645,368 | 7/1997 | Yunick | 404/7 |

FOREIGN PATENT DOCUMENTS

| | | | |
|---|---|---|---|
| 266200 | 11/1968 | Austria | 256/13.1 |
| 356686 | 3/1990 | European Pat. Off. | 256/13.1 |
| 554864 | 8/1993 | European Pat. Off. | 256/13.1 |
| 1295581 | 5/1969 | Germany | 256/13.1 |
| 7408997 | 1/1975 | Netherlands | 256/13.1 |

*Primary Examiner*—James A. Lisehora
*Attorney, Agent, or Firm*—David A. Tamburro

[57] ABSTRACT

Displaceable highway safety barriers extending along the side of a roadway or forming a median strip between opposing roadway sections, the barriers including a number of skid assemblies resting, without attachment, on a supporting surface adjacent a roadway connected by a plurality of semi-rigid, vehicle/barrier interface members extending longitudinally of the roadway.

6 Claims, 3 Drawing Sheets

DISPLACEABLE GUARD RAIL BARRIERS

BACKGROUND OF THE INVENTION

This invention relates to highway safety devices, more particularly to energy absorption displaceable barriers extending along a roadway to intercept an errant vehicle leaving the roadway and redirect it back onto the roadway.

It has long been common practice to install fixed guardrails extending along the sides of roads particularly at especially hazardous sites where there is a sudden or abrupt drop-off or an immoveable object adjacent the road or a sharp curve in the road. The most widely used construction is a guardrail comprising standard metal W beams attached to fixed posts at spaced intervals along the roadway. While such guard rails are effective in most cases in preventing a vehicle from travelling a hazardous area, they achieve this result at the cost of excessive damage to the vehicle, risk of injury to the occupants, and damage to the guardrail itself which often requires rebuilding. Risk of injury and vehicle damage occur because of the high deceleration rates unavoidably imparted to the vehicle and the occupants by contact with a fixed rigid guardrail structure, since deceleration rates are a function of the distance over which the deceleration occurs.

Deficiencies of the current fixed rigid guardrail structure are compounded by the snagging of the impacting vehicle wheel against the exposed base of a tipped support post resulting in unacceptably abrupt deceleration and consequent damage to the guardrail, to the vehicle and undue risk of injury to the occupants.

Attempts have been made to prevent this wheel or hub snagging with "blockouts" arranged between the post and the rail. This expedient, which adds to the complexity and cost of the rail system, is effective only up to the design impact severity, beyond which the support posts are broken or uprooted and struck by a vehicle wheel, constituting, ipso facto, a failure of the design intent.

SUMMARY OF THE INVENTION

It is a principal object of the present invention to overcome these deficiencies of the fixed rigid guardrail systems and provide an improved barrier, which, upon impact by a vehicle, effectively intercepts and redirects the vehicle with significantly reduced damage to the barrier, to the vehicle and risk of injury to the occupants. In achieving this and other related objects the present invention provides a longitudinal barrier system which comprises one or more longitudinally extending vehicle interface members or beams supported at spaced points by slide assemblies which rest without attachment on a support surface and which are thus free to be displaced by an errant vehicle, limited only by the inertia of the barrier mass and surface friction.

Upon impact, the displacement of the barrier system achieves the imperative of acceptable deceleration rates by increasing the distance over which the desired vehicle deceleration is effected. The reduction in these G levels effectively attains the primary objective of any barrier, that is, of reducing the risk of injury to occupants. Since the barrier moves when impacted by a vehicle, instead of being crushed or deformed against a rigid backup, damage to the barrier itself is virtually eliminated.

Vaulting or overrunning the barrier by vehicles impacting at over-design speeds or at inordinately high angles of impact is prevented because the barrier moves with the impacting force and the impinged surface remains vertical and thus does not cause ramping or vaulting. Further, the barrier of the present invention absorbs impacts with a low initial non-resilient counterforce, increasing with displacement, without inducing undesirable vehicle rejection vectors. Thus vehicles will proceed in continuing contact with the barrier on a course essentially parallel with the roadway. This is in contrast with the severity of impact against rigid guardrails which often result in violent rebound of vehicles back into the traffic stream.

Further, although the barrier rests without attachment to the ground or other supporting surface, the weight of the assembly and in particular the weight of the rails, the heaviest component, counters the tendency of the barrier to lift the contact point or overturn rearwardly. Any tendency of the vehicle to ramp or the barrier itself to overturn is virtually eliminated by positioning the guardrails essentially at the height of the center of gravity of the average vehicle.

Additional objects and advantages will become apparent as the description proceeds in connection with the accompanying drawings.

DESCRIPTION OF THE PREFERRED EMBODIMENTS

Figure 1:
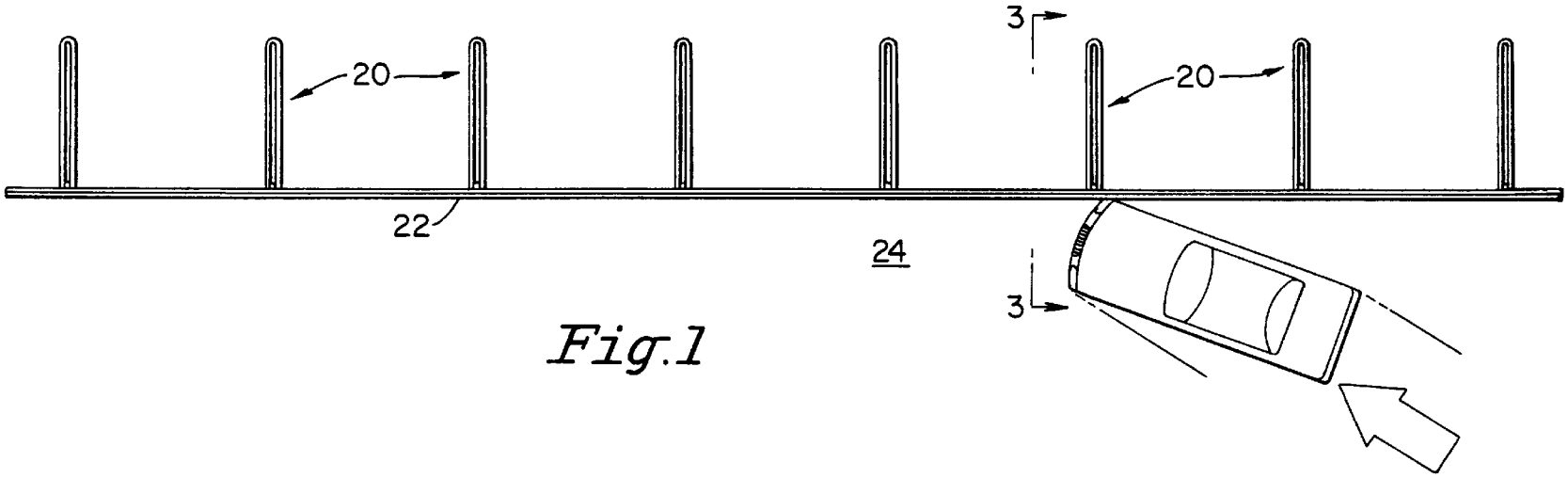
FIG. 1 is a top plan view of a portion of a barrier constructed in accordance with the present invention installed along one side of a roadway.
Figure 2:
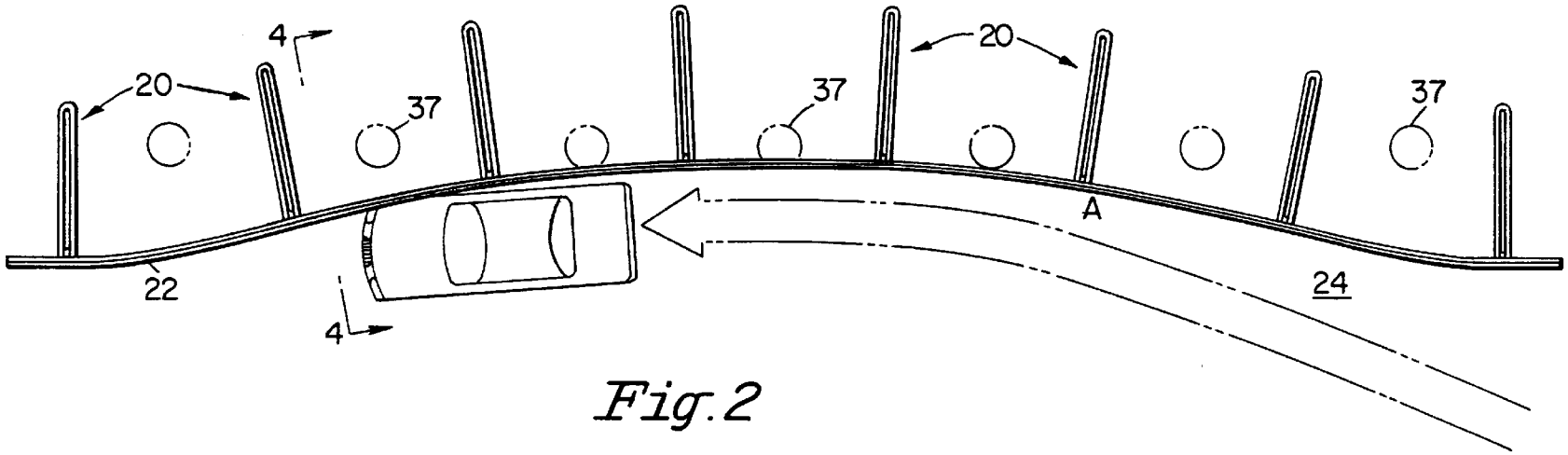
FIG. 2 is a view similar to FIG. 1 showing a typical displacement of the barrier upon impact by an errant vehicle.
Figure 3:
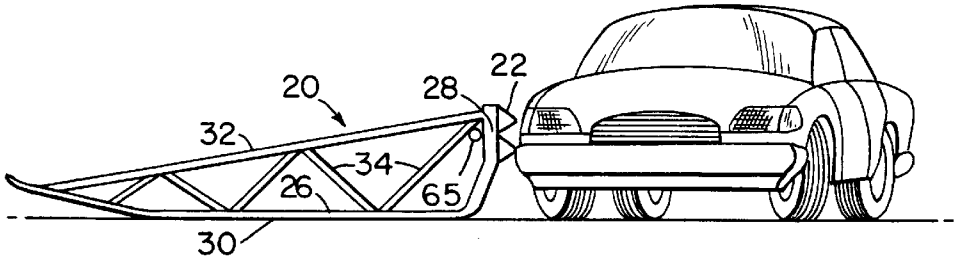
FIG. 3 is a section taken along line 3—3 of FIG. 1 showing a typical skid assembly as it appears at rest or under light impact.

Referring now more particularly to the drawings and especially to FIGS. 1–3, the barrier of the present invention comprises a plurality of skid assemblies each indicated generally at 20 connected by one or more rails or beams 22. In a typical installation the barrier extends along the side of a roadway 24 with the individual skid assemblies disposed parallel to one another and normal to the direction of the roadway. The spacing between the skid assemblies will vary depending upon the site conditions, the type of roadway, the type of vehicular traffic and the anticipated speeds. Typically, it is expected that the spacing between adjacent skid assemblies will be 12 to 24 feet.

Figure 4:
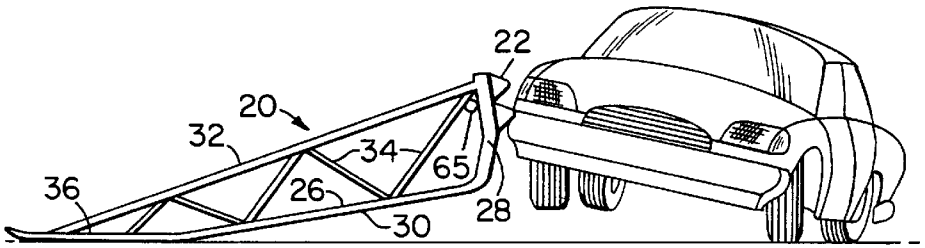
FIG. 4 is a similar section illustrating the barrier with an optional upturned skid in displaced position under severe impact.

The individual skid assemblies are of essentially open framework design and may be constructed of steel or aluminum in tube, beam, plate or cast configurations, a typical example being shown in FIG. 3. As illustrated there, the assembly comprises a lower skid member 26 having a portion resting on the ground and a forward portion offset to prevent wheel snagging and to provide a mounting area 28 to which the rails or beams 22 are bolted. In the embodiment shown in FIGS. 3 and 4 the rail is the standard W beam now in widespread use on highways. However, one or more aluminum tubes of the type used in bridge railing or other dedicated shapes in aluminum or steel may also be employed.

The bottom flat portion of the skid member 26 rests without attachment on the ground and has on its lower surface a flat skid plate 30, typically 10 inches wide which is sufficient to assure that the skid assembly will slide freely over a supporting surface upon impact by a vehicle. To overcome the coefficient of static friction and to facilitate this free sliding action, the skid assemblies may be supported on a bed of gravel or sand where conditions warrant. In this example, the skid assemblies also include a top compression member 32 and a suitable number of truss members 34 extending between the upper and lower members 32 and 26.

The skid assemblies are so dimensioned that the rails or beams 22 are disposed approximately at the same height as the height of the center of gravity of the average vehicle as dictated by that of the existing vehicle population. While the overall dimensions of the individual skid assemblies may vary substantially it is expected that typically they will be six to ten feet long.

The barrier is designed primarily to intercept and redirect average passenger type vehicles impacting at design speeds and angles of about sixty miles per hour and 25° maximum. However, vehicles with higher CGs such as large pickups, vans, sport utilities and light trucks will benefit from a more closely matched height of barrier resistance. With these vehicles, low force impacts will cause barrier sliding movement while higher forces may elevate the vehicle-barrier interface. In the present invention, emphasis is made of the advantages realized by retaining a vertical interface between the longitudinal beam and the vehicle. That is the desired and intended performance when normal impact conditions exist, i.e., when a representative vehicle, with respect to its weight and center of gravity, impacts at design speeds and angles, which meet current Federal Highway Administration criteria. To preserve the sliding action of the skid assemblies when struck by a vehicle at over design speeds or angles, the rearmost portion of the skid assemblies may be upturned as at 36 in FIG. 4, typically at an angle in the order of 15°. Thus, on impact by a truck or atypical vehicle, the skid assembly can assume the position shown in FIG. 4, depending upon the severity of impact. If it is modest, no tipping action will occur.

The interaction of the barrier and an impacting vehicle in a typical case is shown in FIG. 2. Assuming that the vehicle first contacts the barrier at the area A, the skid/beam assembly will be displaced at that point, and as the lateral movement increases, the adjacent skid/beam assemblies will also be displaced, thus progressively increasing the total resistance. The resistance to displacement is the sum of the inertia of the total mechanical assembly being accelerated, and the sliding friction generated by its movement. Initially the resistance to the displacement of the barrier is relatively low thus providing time for occupants to be relocated against the vehicle interior before higher Gs are generated which results in a favorable occupant "ride-down" rate, thereby reducing the prospect of injury and of damage to the vehicle and to the barrier itself. As the vehicle progresses into and displaces a greater length of the barrier, its speed decreases and the resistance to displacement of the barrier increases because of the accumulated mass and the friction factor of the adjacent skid/beam assemblies. It is anticipated that at typical impact angles and velocities, the vehicle will be effectively redirected with minimum damage to the vehicle and the barrier and minimal risk of injury to the occupants. The degree of displacement may be reduced by the installation of inertial masses such as sand tubs 37 for incremental resistance or mechanical means such as imbedded posts for a positive stop, placed at an appropriate distance behind the initial location of the barrier. A cable 65 may be threaded through the skid assemblies behind the rail/beams at a level matching the CG height of the average vehicle to further resist any rearward overturning tendency of the skid assemblies and to retain the perpendicular relationship of the skid assemblies and the rail/beams as the assembly is displaced rearwards.

After an impact the barrier may be restored to its original configuration by service vehicles pushing from the rear of the assembly or pulled from the front.

As noted, the rate of deceleration of a vehicle is a function of the distance over which it occurs; the greater the distance the lower the deceleration rate. The current guardrail construction now in widespread use is rigid by design with its posts firmly imbedded in the surface and its fixed position augmented by tensioning anchors at each end. Accordingly, any deceleration of an impacting vehicle must take place as the vehicle travels a matter of inches which routinely results in life-threatening and destructive rates of deceleration. In contrast, the deceleration effected by the barrier of the present invention can occur over several feet thus reducing the deceleration rates to levels which are survivable without serious injury and which conserve property, public and private.

Figure 5:
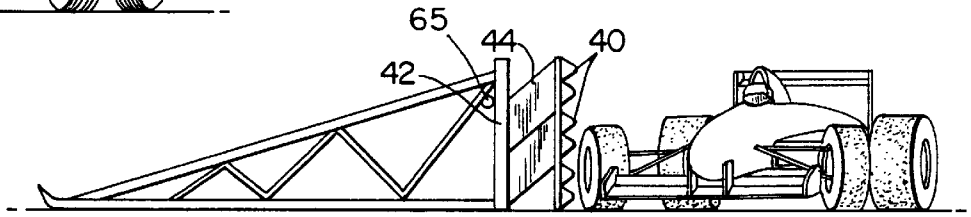
FIGS. 5 and 6 are side elevations showing alternate configurations of individual skids.
Figure 6:
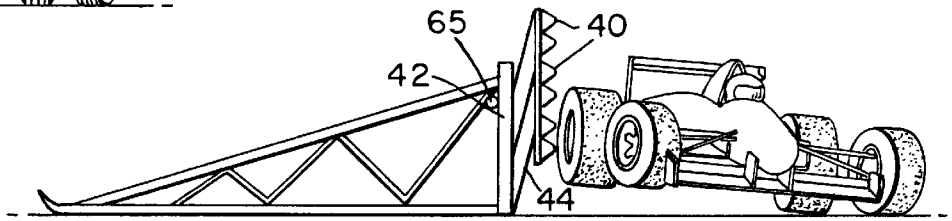

In some cases it may be desirable to raise the rail impacted by the vehicle to counter the vehicle lift and reduce inertial loads. As shown in FIGS. 5 and 6, one or more W beams 40 may be secured to a vertical member 42 forming the forward edge of a slightly modified slide assembly by a linkage indicated generally at 44. FIG. 5 shows the barrier at rest while FIG. 6 shows the position of the rails 40 upon impact by a vehicle. Optionally the linkage 44 may be replaced by self-restoring flexible tubes.

Figure 9:
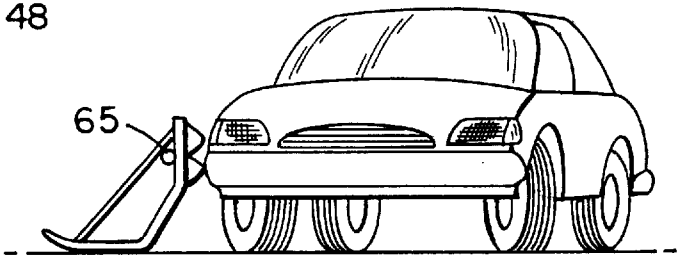
FIG. 9 is a side elevation of a variation of the present invention embodying a reduced skid assembly construction.

FIG. 9 illustrates a modification of the barrier which is of reduced size, weight and complexity of structure which may be used in areas where there are space constraints or where lower vehicle speeds may be expected.

It is anticipated that further analysis and full scale testing may establish that the mass of the assembly in combination with the tension of the cable may in fact be sufficient to achieve the desired results in all locations.

Figure 7:
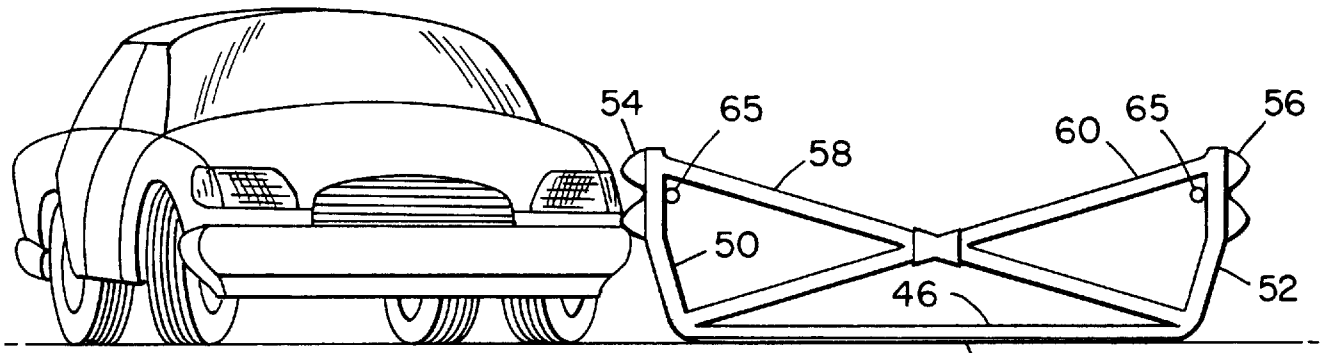
FIG. 7 and 8 are side elevations of further embodiments of the present invention suitable for installation as a median barrier.
Figure 8:
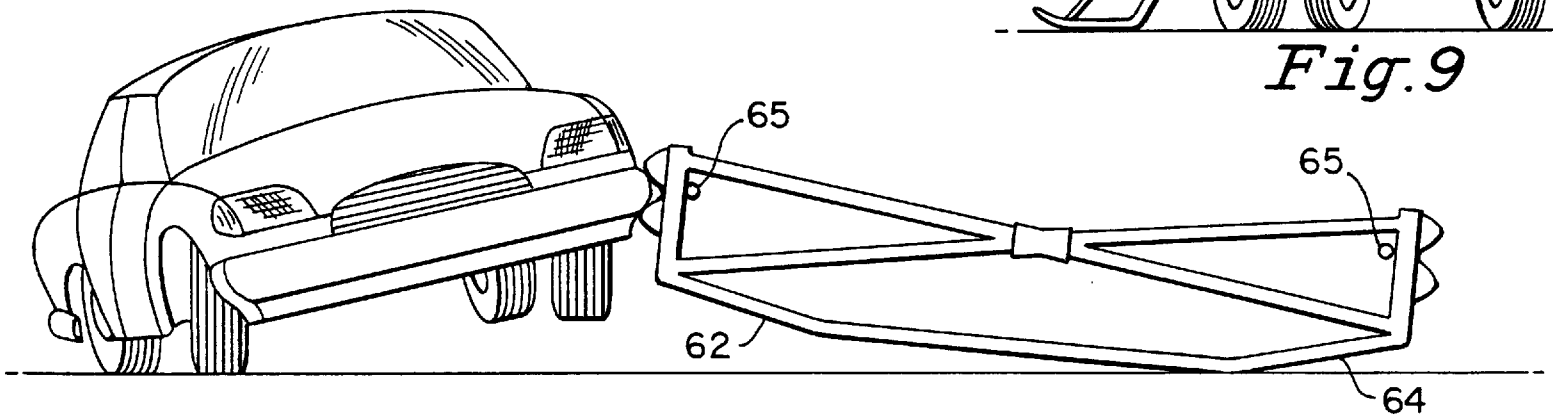

The barrier of the present invention may also function as a redirecting median barrier, typical configurations for this purpose being shown in FIGS. 7 and 8. The skid assemblies of FIGS. 7 and 8 may be constructed of tube, beam, plate or castings. In FIG. 7, a lower tubular member 46 carries a flat skid member 48 on its lower surface and its opposite ends have off-set portions 50 and 52 to which are bolted the standard W beams 54 and 56. As before, the W beams are disposed at the CG height of average vehicles. The skid assembly is completed by brace members 58 and 60.

The median barrier of the present invention may also assume the configuration shown in FIG. 8 which is essentially the same as that shown in FIG. 7 except that the end portions of the bottom slide member are upturned slightly as at 62 and 64 to provide an automatic elevation of the vehicle interface and of the barrier resistance level, in order to more closely, if not exactly, match that of the CG of the impacting vehicle, be it passenger car, mini-van, pick-up or truck, as impact severity increases. The action of the median barrier is exactly as described above in connection with the embodiments of FIGS. 1, 2 and 3. In all cases the barrier is force-sensitive, accumulating mass and surface friction generated by the sliding assembly over the distance traversed, in proportion to impact loading.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A longitudinal displaceable barrier assembly for intercepting and redirecting errant vehicles leaving a roadway comprising a series of skid assemblies each having a lower skid member resting, without attachment, on a supporting surface adjacent said roadway, said skid assemblies also having a support structure positioned above said support surface, and a series of essentially horizontal rails or beams carried by said support structure and extending along the length of said roadway for lateral impact by an errant vehicle, said rails or beams disposing said skids in predetermined spaced relation with each other and with said skid members extending essentially normal to the direction of said roadway, said skid members being slidably laterally displaceable on said support surface upon lateral impact of an errant vehicle with said rails or beams.

2. The barrier assembly according to claim 1 wherein said rails or beams are positioned substantially at the height of the center of gravity of typical vehicles.

3. The barrier assembly according to claim 1 wherein the displacement of the barrier assembly is limited by free-standing masses or surface-engaging mechanical means positioned behind the rail/beam members.

4. The barrier assembly according to claim 1 wherein the initial inertial resistance of the barrier assembly is reduced by a pivoting linkage between the rails or beams and said support structure.

5. The barrier assembly according to claim 1 wherein the lateral displacement of the barrier assembly and rearward overturning impact forces are limited by a cable in tension threaded through the skid assemblies proximate to the center of gravity of typical vehicles and behind the horizontal rails or beams.

6. A longitudinal displaceable barrier assembly for intercepting and redirecting errant vehicles leaving a roadway comprising a series of skid assemblies each having a lower skid member adapted to rest, without attachment, on a supporting surface adjacent said roadway, said skid assemblies also having a support structure positioned above said support surface, and a series of essentially horizontal rails or beams carried by said support structure and extending along the length of said roadway, said rails or beams disposing said skids in predetermined spaced relation with each other and with said skid members extending essentially normal to the direction of said roadway, the rearmost portion of the lower skid member being upturned at an angle on the order of 15° relative to the supporting surface to provide a secondary skid/surface interface which automatically raises the level of the vehicle/beam contact upon severe impact.

* * * * *